US008176952B2

(12) United States Patent
Albrecht

(10) Patent No.: US 8,176,952 B2
(45) Date of Patent: May 15, 2012

(54) DEVICE FOR PREVENTING FILLED VESSELS FROM SPILLING DURING CONVEYING OF THE SAME

(75) Inventor: Herr T. Albrecht, Beilngries (DE)

(73) Assignee: Krones AG, Neutraubling (DE)

( * ) Notice: Subject to any disclaimer, the term of this patent is extended or adjusted under 35 U.S.C. 154(b) by 988 days.

(21) Appl. No.: 11/915,137

(22) PCT Filed: May 10, 2006

(86) PCT No.: PCT/EP2006/004360

§ 371 (c)(1),
(2), (4) Date: May 9, 2008

(87) PCT Pub. No.: WO2006/125523

PCT Pub. Date: Nov. 30, 2006

(65) Prior Publication Data

US 2009/0044878 A1 Feb. 19, 2009

(30) Foreign Application Priority Data

May 21, 2005 (DE) ..... 10 2005 023 535

(51) Int. Cl.
*B65B 1/04* (2006.01)

(52) U.S. Cl. ..... 141/311 A; 141/144; 53/428

(58) Field of Classification Search ..... 141/144–148, 141/311 A; 53/428; 198/832.1
See application file for complete search history.

(56) References Cited

U.S. PATENT DOCUMENTS 2,328,372 A 8/1943 Wollenweber
2,362,848 A * 11/1944 Pearson ..... 198/431
4,201,251 A * 5/1980 Bennett et al. ..... 141/284
4,567,919 A * 2/1986 Fogg et al. ..... 141/1
5,335,474 A 8/1994 Ruetschi et al.
5,538,054 A * 7/1996 Luhmann et al. ..... 141/198
5,588,279 A * 12/1996 Runnberg et al. ..... 53/426
5,911,249 A 6/1999 Sanfilippo et al.
6,041,576 A * 3/2000 Anchor et al. ..... 53/473
6,129,204 A * 10/2000 Owen et al. ..... 198/832.1
6,418,701 B1 * 7/2002 Navarro ..... 53/415
6,588,622 B1 * 7/2003 Leishman et al. ..... 220/719
6,694,705 B1 * 2/2004 Frei et al. ..... 53/428
7,621,301 B2 * 11/2009 Wu et al. ..... 141/91

FOREIGN PATENT DOCUMENTS

AU 843766 1/1969
DE 25 05 355 8/1976
DE 2505355 8/1976

OTHER PUBLICATIONS

International Search Report for International Application PCT/EP2006/004360, dated Sep. 19, 2006.

Written Opinion for International Search Report for International Application PCT/EP2006/004360, dated Sep. 19, 2006.

* cited by examiner

*Primary Examiner* — Timothy L Maust
(74) *Attorney, Agent, or Firm* — Marshall, Gerstein & Borun LLP

(57) ABSTRACT

A system for conveying open containers filled with liquid, especially wide-necked containers, whereby the containers can be conveyed in the open state safely and without contamination, including an anti-slosh device which prevents the liquid from sloshing out as the containers are being transported.

11 Claims, 5 Drawing Sheets

DEVICE FOR PREVENTING FILLED VESSELS FROM SPILLING DURING CONVEYING OF THE SAME

CROSS-REFERENCE TO RELATED APPLICATION

The present application claims the benefit of priority of International Patent Application No. PCT/EP2006/004360 filed on May 10, 2006, which application claims priority of German Patent Application No. 10 2005 023 535.2 filed May 21, 2005. The entire text of the priority application is incorporated herein by reference in its entirety.

FIELD OF DISCLOSURE

The disclosure pertains to a system and to a method for conveying open, liquid-filled containers.

BACKGROUND OF THE DISCLOSURE

In the process of filling containers with liquid, it is often necessary to transport the containers in the open state after they have already been filled with the liquid. This need exists, for example, in the area between a filling device and a capping device. For reasons of sales psychology, it is desirable for containers to be filled as full as possible, because the buyer will reject a partially filled container in the belief that it does not contain the full amount promised, even if the container is overdimensioned and the content corresponds exactly to the nominal value. In the case of containers which are filled up to the top or close to the top, however, there is the danger that the liquid can slosh out; that is, some of the nominal content can be lost and, the outside surfaces of the containers and the conveyor device can be contaminated. This danger becomes worse as the transport speed increases and is especially severe in the case of containers with a wide neck such as jars or the wide-neck bottles now coming into more widespread use.

SUMMARY OF THE DISCLOSURE

The disclosure is based on the task of creating a system and a method which make it possible to convey open, liquid-filled containers easily and at high speed.

Through the disclosed design, bottles with standard-sized openings as well as wide-neck containers can be conveyed at high speed without the danger that the liquid will slosh out and be lost or that the machinery and the containers will become contaminated.

The anti-slosh device is advisably installed at the transition between two conveying devices, i.e., the place where the danger of sloshing is the greatest.

Because it is almost impossible, especially at high transport speeds, to determine the exact position where sloshing occurs, it is advisable to design the anti-slosh device in such a way that it acts over a certain predetermined distance along the transport route. As a result, the anti-slosh device will also act over a longer period of time on the liquid, which contributes to the reliable prevention of sloshovers.

The anti-slosh device is designed in such a way that it exerts a restraining pressure on the surge which develops inside the container. This is achieved preferably in a simple manner by injecting a gas under pressure through a nozzle, which is aimed at a point inside the container where a surge can be expected to develop. This most-likely surge formation point can be determined empirically, or it can be calculated on the basis of the prevailing accelerations, centrifugal forces, and inertial forces.

Because the surge which forms at the inside surface of the container will always be close to and underneath the opening of the container, the nozzle is preferably directed at this point.

To prevent the liquid from experiencing a new pulse of energy as a result of the abrupt termination of the restraining pressure, that is, of the injection of the gas, since this could lead to additional sloshing, the velocity of the gas flow is preferably decreased from a higher value at the beginning of the injection process to a lower value at the end of the injection process.

To ensure that the anti-slosh device acts over a certain predetermined distance along the transport route, the nozzle can be designed as a slot nozzle with a predetermined length in the transport direction. The nozzle is preferably stationary. It is also possible, however, to provide a nozzle which can be carried along over the predetermined transport distance.

The inventive design is suitable especially for conveyor systems with circular conveyors arranged in series. As experience has shown, sloshing frequently occurs in the area where the containers are transferred from one conveyor to another, because here is where the transport direction changes. By using the nozzle proposed according to the invention to inject gas into the containers, the transfer of the filled containers from a filling machine or a transfer device, for example, to a capping machine can be accomplished smoothly and at high speed without the fear of sloshing.

An especially preferred method for preventing sloshing consists in injecting gas under pressure into the interior of the container.

BRIEF DESCRIPTION OF THE DRAWINGS

An exemplary embodiment of the disclosure is explained in greater detail below on the basis of the drawings.

DETAILED DESCRIPTION

Figure 1:
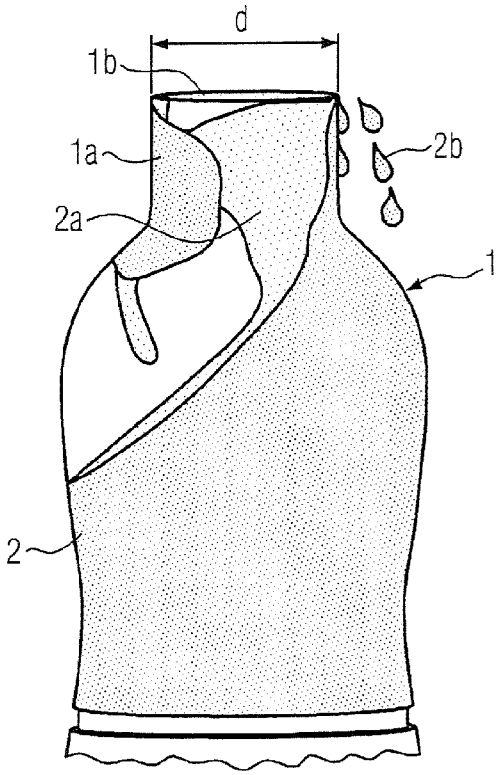
FIG. 1 shows a schematic diagram of the formation of a surge.

FIG. 1 shows the processes which occur during the formation of a surge in a container 1, which is filled with a liquid 2. The container 1 is a so-called wide-necked container; that is, it has a neck 1*a* with an opening 1*b* of a diameter "d" which is larger than the diameter of standard bottles such as wine or beer bottles. These types of containers 1 are used, for example, to hold juice, milk, milk-based drinks, or yogurt preparations.

Under unfavorable, discontinuous, or abrupt transport movements, such as those which can occur when, for example, the transport direction changes during a transfer from one conveyor to another or during a sudden acceleration or a sudden braking, a surge 2*a* forms in the container 1. That is, as a result of inertia, the liquid 2 rises along the inside surface of the container on one side and falls on the opposite side. Depending on the intensity of the pulse which causes the surge to form, the liquid can slosh out; that is, a portion 2*b* of the liquid can splash out or escape from the opening 1*b* of the container 1, whereas the rest of the liquid of the surge 2*a* falls back into the container 1 and acquires an essentially flat surface again after the energy of the pulse has dissipated.

Figure 2:
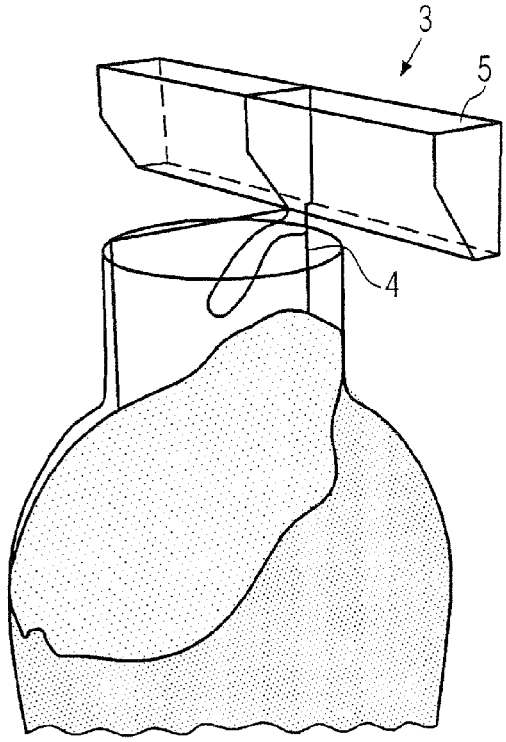
FIG. 2 shows a schematic diagram of the effect of an exemplary embodiment of the disclosed design.

To prevent the liquid 2 from sloshing out, an anti-slosh device 3 is used, the action of which is explained in greater detail on the basis of FIG. 2. With this anti-slosh device 3, it is possible to exert a restraining force on the liquid 2, namely, a force effectively and locally limited to the place where a surge 2*a* can be expected to form. A most-likely slosh formation point 4 of this type can be determined empirically or calculated, and it will usually be located, for example, where there is a changeover from one conveyor device to another, namely, at the point where the liquid 2 is subjected to the transport forces of the new conveyor device. Because at least the portion 2*b* of the surge 2*a* which sloshes out is previously located at the inside surface of the container 1, it can be assumed that a most-likely surge formation point 4 is located with the greatest probability on the inside surface of the container 1.

To apply a restraining force to the surge 2*a*, it is preferable to use a gas under pressure. For this purpose, air or some other suitable gas, possibly a sterile and/or inert gas, can be used. The gas is directed through a nozzle 5 at the most-likely surge formation point 4 on the inside surface of the container 1 and thus restrains the formation of a surge 2*a* in this area at least to such an extent that sloshing-out is prevented.

Figure 3A:
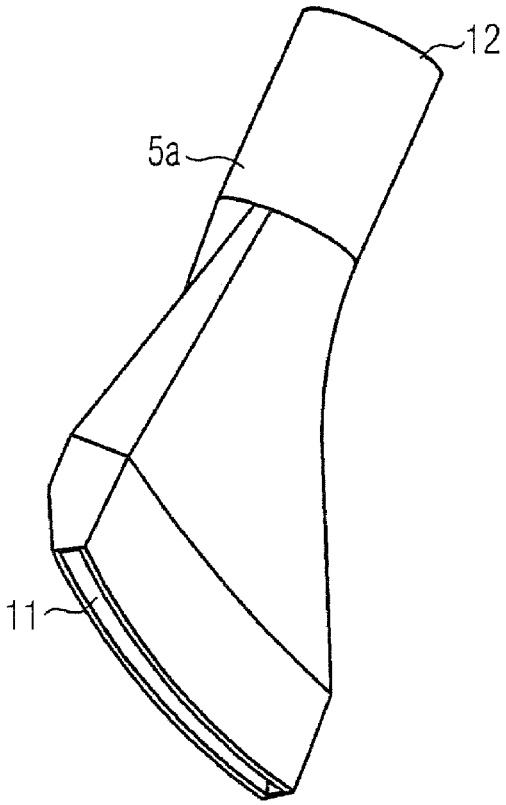
FIG. 3A shows a view in perspective and FIG. 3B a longitudinal cross section.
Figure 3B:
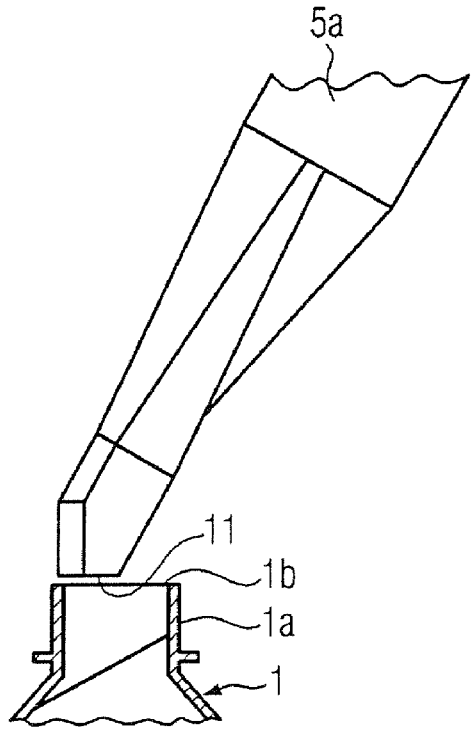
FIG. 3 shows a diagram of the shape of a nozzle, where

FIG. 3 shows an enlarged view of an exemplary embodiment of a symmetric nozzle 5*a* with a nozzle orifice 1, which is arranged symmetrically to, and in a direct line with, a gas feed inlet 12. FIG. 3A shows a view from below, and FIG. 3B shows a cross section through the nozzle orifice 11. It is advisable, although not absolutely necessary, to provide the nozzle slot or nozzle orifice 11 with a certain curvature to adapt it to the curvature of the transport section and/or to the curved inside contour of the container 1, as can be seen in FIGS. 3A and 3B. It can also be seen that the nozzle orifice 11 is oriented in such a way that the gas is injected under pressure near the inside wall in the neck area 1*a* of the container 1 and onto the surface of the liquid in the container 1 in such a way that the flow of gas is essentially parallel to and a certain distance away from the center line of the neck 1*a*.

The pressure used to inject the gas can be either calculated or determined empirically and is on the order of approximately 500 Pa.

Figure 4:
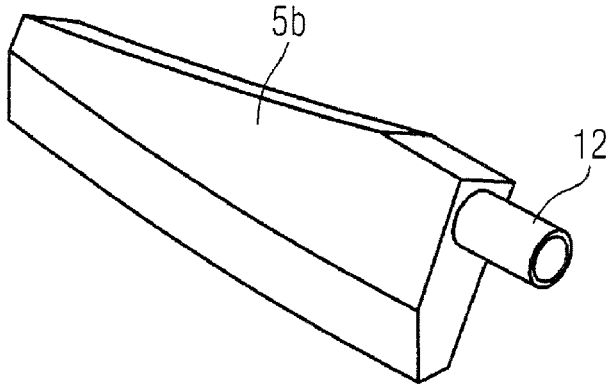
FIG. 4 shows a view, in perspective, of a nozzle with a different shape.

It has been found advisable to allow the flow of gas to taper off slowly, because an abrupt termination would subject the liquid to an additional pulse of energy, which could lead to the formation of another surge. This can be achieved passively by the use of a suitably designed nozzle 5. As is the case, for example, with the nozzle 5*b* shown in FIG. 4, most of the gas exits the nozzle orifice 11 in the area near the gas inlet, whereas the exit velocity decreases with increasing distance from the gas feed inlet 12. The nozzle 5*b* differs from the nozzle 5*a* by its asymmetric design. In particular, the feed inlet 12 for the compressed gas is located at the beginning of the nozzle orifice 11, i.e., to one side of it, whereas the volume of the interior space in the nozzle decreases with increasing distance from the inlet 12. The design of the nozzle orifice 11 is similar to that of nozzle 5*a*.

Another possibility is to expand the nozzle orifice 11 in a wedge-like manner in the transport direction of the containers 1. As a result, the exit velocity decreases progressively even though the pressure remains the same.

It is also possible, however, to control the pressure actively in such a way that it decreases during the passage of a container 1 under the nozzle orifice 11. This pressure control is especially suitable for anti-slosh devices in which only one container is located under the nozzle 5 at a time.

Figure 5:
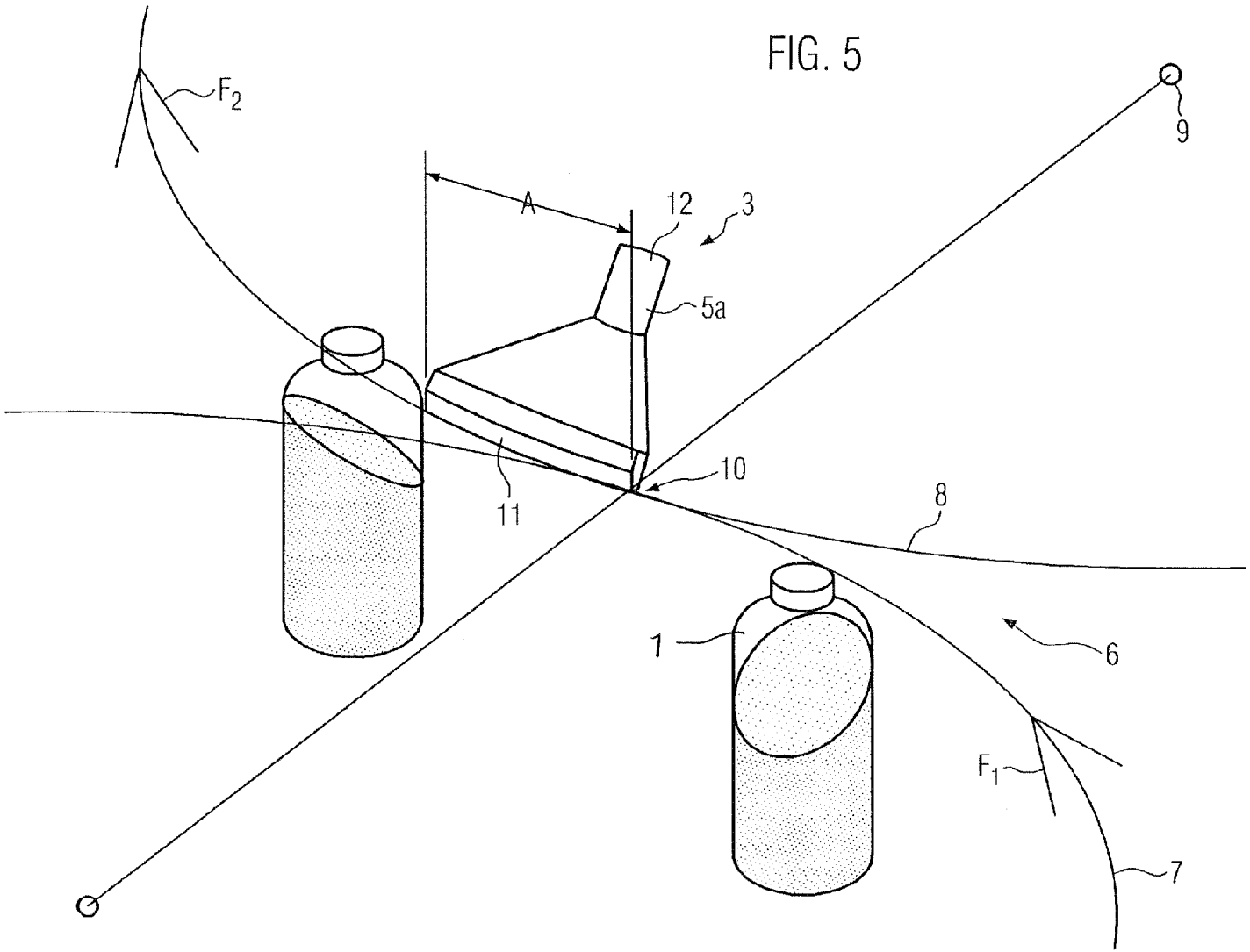
FIG. 5 shows a schematic diagram of a first exemplary embodiment of the disclosed system.

FIG. 5 shows the application of the disclosed principle to a first exemplary embodiment of an disclosed system 6. The system 6 comprises a first conveyor 7, indicated only schematically. It is designed here as a circular conveyor, and it carries a plurality of holders (not shown), each of which holds one container 1. The containers 1 are carried by the first conveyor 7 in a transport dimension F1 along a circular path around a center of rotation (not shown) of the conveyor 7. A second conveyor 8 is also provided, to which the containers 1 arriving in the transport direction F1 are transferred and then conveyed onward in a transport direction F2 along a circular path around a center of rotation 9 of the second conveyor 8. The transfer takes place by means of a transfer device 10, which is indicated in the schematic diagram of FIG. 5 only by the point at which the transfer occurs. The transfer device 10 is located at the point where the conveyors 7 and 8 are the closest together, and it leads to a change in the transport direction F from a first circular path F1 to a second circular path F2. That is, an S-shaped transport curve is established for the containers 1, and this is associated with a change in the sign of the centripetal acceleration. The transfer device 10 can be formed, for example, by stationary guide rails for the containers.

As FIG. 5 shows, a surge develops as a result of the transport movement on the first conveyor 7. This surge rises along the inside surface of the container 1 facing away from the rotational axis of the conveyor 7. The surge will also form on the conveyor 8, but on the opposite inside surface of the container 1. As a result of the movement of the liquid from one inside surface to other inside surface, there exists the danger that some of the liquid will slosh out of the container, but this is prevented by the inventive anti-slosh device 3. The anti-slosh device 3 comprises the nozzle 5*a*, which, in the exemplary embodiment shown here, is stationary and is designed as a slot nozzle. The nozzle orifice is preferably curved around the rotational axis 9 of the second conveyor 8. The nozzle 5*a* is assigned to the transfer device 10 and is installed in particular above the second conveyor 8 immediately downstream from the transfer point. The nozzle orifice 11 of the nozzle 5*a* extends over a predetermined distance "A" along the transport route in the transport direction F2 of the second conveyor 8 downstream from the transfer device 10, i.e., from the transfer point. The nozzle orifice 11 is directed at the opening 1*b* of the containers 1 and at the inside wall facing away from the rotational axis 9 during transport by the second conveyor 8, that is, at the outward-facing wall. As a result, it is ensured first that gas is injected under pressure for a sufficient length of time onto the surface of the liquid of the developing surge at the most-likely surge formation point 4, so that sloshing is prevented. Second, it is ensured at the same time that, regardless of circumstances, gas will still be blown onto the surface of the developing surge even if surge formation has been delayed. Such delays can occur, for example, when the container 1 is slightly tilted or when some other type of irregularity occurs during operation. The transport distance A over which it is possible for the gas to be injected extends preferably over an arc of 10-15 degrees and especially over an arc of approximately 13 degrees, but this can be varied in accordance with specific circumstances such as the type and properties of the liquid, the degree to which the container is filled, the transport rate, the manner in which the transfer is accomplished, the size of the container opening, the shape of the container, etc.

Figure 6:
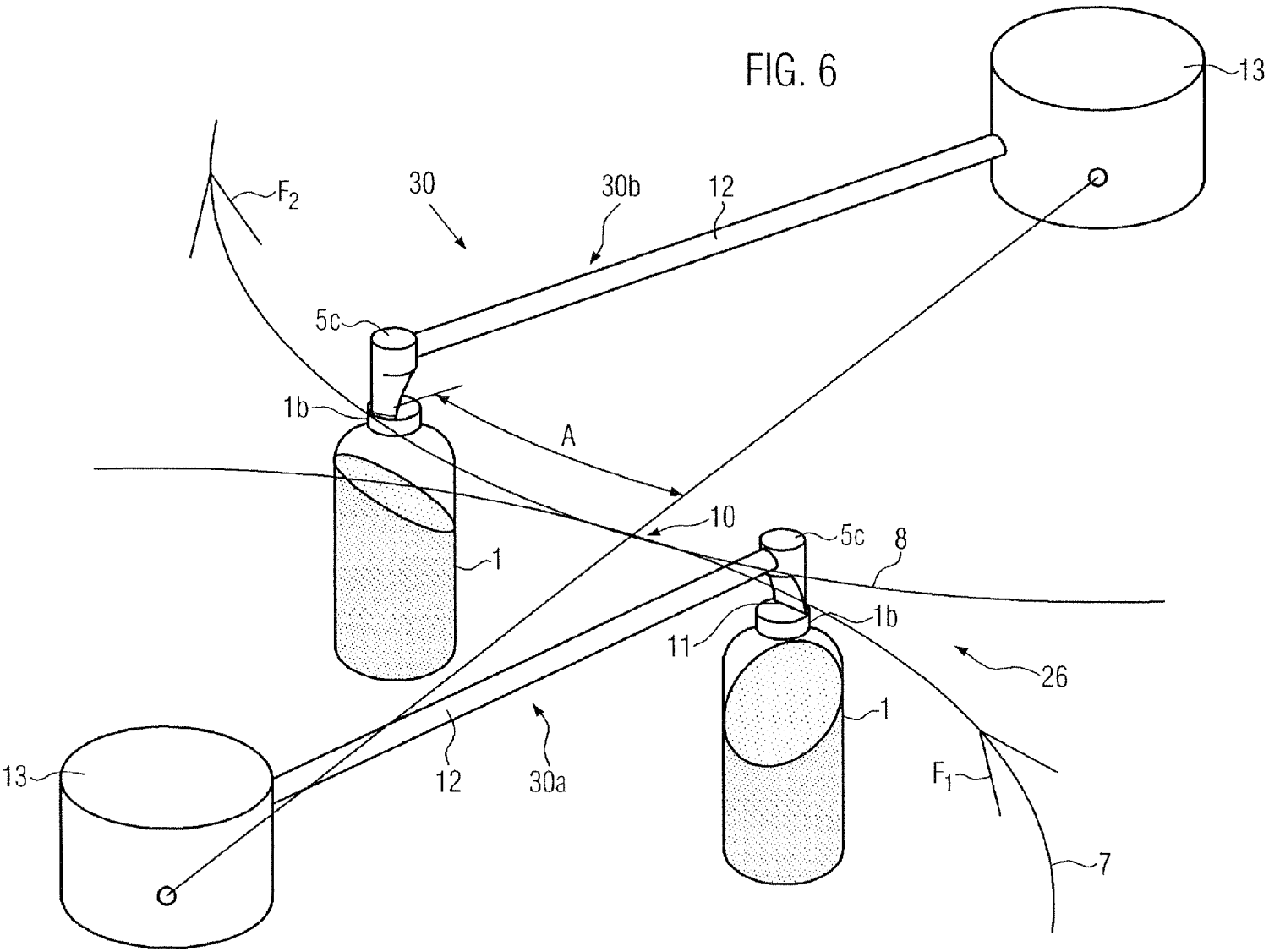
FIG. 6 shows a schematic diagram of another exemplary embodiment of the disclosed system.

FIG. 6 shows another exemplary embodiment of the described designed system 26, which is the same as the system 6 according to FIG. 5 except for the details to be described below. The same or comparable components are designated by the same reference numbers and will thus not be explained again. The system 26, however, contains an anti-slosh device 30 of a different design.

In the exemplary embodiment presented here, the system 26 contains an anti-slosh device 30*a*, 30*b* for each of the two conveyors 7 and 8; they are of identical design except for the modifications required to adapt them to the different conveyors 7 and 8. The anti-slosh device 30 contains a nozzle 5*c* for each container 1 being transported on the associated conveyor 7, 8. The nozzle 5*c* moves together with the assigned container 1 at the same speed and over the same transport distance as the assigned container 1. The nozzle 5*c* also has a curved nozzle orifice 11', which extends over a predetermined distance A in the transport direction, which essentially matches the inside width of the container opening 1*b*, so that the compressed gas is blown only into the opening 1*b* and not onto the outside surface of the container 1. The nozzle orifice 11' is directed onto a most-likely surge formation point 4 at and parallel to the inside wall of the container 1. For each of the two circular conveyors 7, 8, this point is located on the side of the inside surface of the container 1 which faces away from the associated rotational axis. Each of the nozzles 5*c* is connected by a compressed gas feed line 12 to a gas distributor 13, which is preferably located on the rotational axis of the associated conveyor 7, 8. The gas distributor 13 ensures that each nozzle 5*c* is supplied with compressed gas over a predetermined transport distance A.

In the case of the anti-slosh device 30*b* on the second conveyor 8, the predetermined transport distance A extends over essentially the same transport distance down-stream from the transfer device 10 as was described on the basis of the system 6 according to FIG. 5. The gas distributor 13 on the second conveyor 8 also ensures that the injection pressure, i.e., the pressure which is exerted on the surface of the liquid, decreases from a higher value in the vicinity of the transfer device 10 to a lower value at the end of the transport distance A.

When the anti-slosh device 30*a* of the first conveyor 7 of the system 26 is used, it becomes possible to increase the velocity of the conveyor 7 without causing any sloshing of the liquid. For this purpose, the gas distributor 13 ensures that the nozzle 5*c* of the anti-slosh device 30*a* injects gas during the entire time that the associated container 1 is being transported on the first conveyor 7. This prevents the liquid from rising along the inside wall of the container 1 while it is on the conveyor 7, namely, the rise which is caused by the centrifugal forces developing on the conveyor 7.

The following table shows an example of the active control of the injection pressure over the required transport distance A when a container according to FIG. 2 is being transferred by a star wheel transfer device (pitch circle, 1,080 mm) to a capping machine (pitch circle, 1,080 mm) for a system output of 55,000 bottles/hr with a filling level of 22.8 mm at 1,666 revolutions per hour (166.6°/sec).

| Pressure | Start | End | Time (sec) | Angle, ° |
|---|---|---|---|---|
| 500 Pa | 0.255 sec | 0.305 sec | =0.05 | 8.33° |
| 300 Pa | 0.305 sec | 0.315 sec | =0.01 | 1.66° |
| 150 Pa | 0.316 sec | 0.325 sec | =0.01 | 1.66° |
| 50 Pa | 0.326 sec | 0.335 sec | =0.01 | 1.66° |
| Total Distance = 13.31° | | | | |

As can be seen, after 0.05 sec the pressure at the nozzle outlet is reduced in stages to 0 Pa. The rise in the liquid at the end of the injection process can be reduced even more by decreasing the pressure even more slowly.

Figure 7:
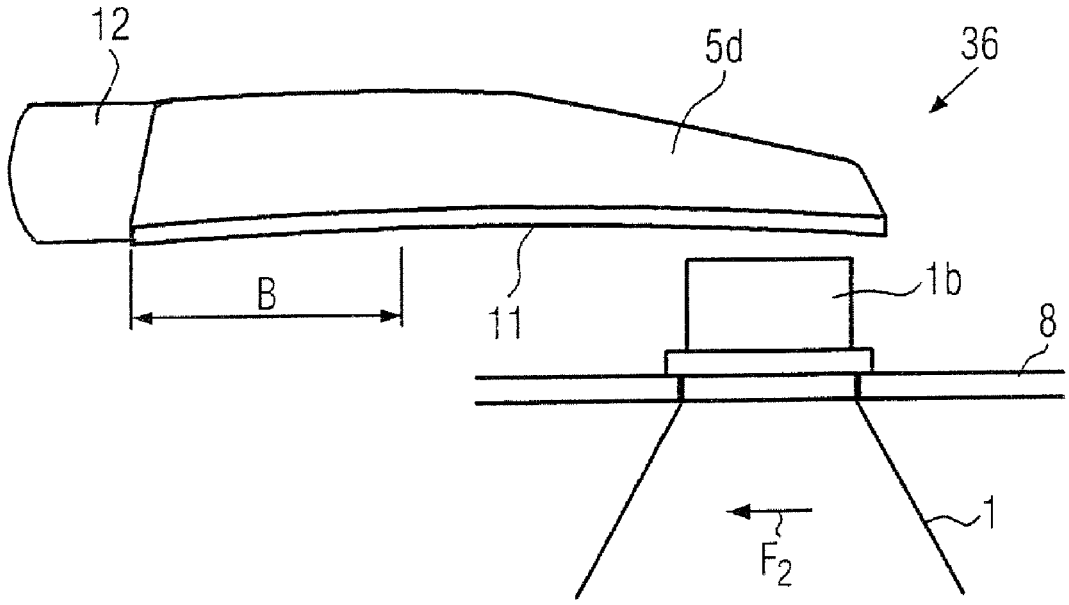
FIG. 7 shows a schematic diagram of another exemplary embodiment of an disclosed system.

The system 36 according to FIG. 7 differs from the system 6 according to FIG. 5 essentially in that here an asymmetric nozzle 5*d* with a nozzle orifice 11 of constant width is used. The gas feed line 12 is connected laterally to the end of the nozzle 5*d* facing in the transport direction F2. For this reason and also because the height of the nozzle 5*d* decreases in the direction opposite the transport direction F2, the flow velocity of the outgoing gas decreases gradually in the area B of the nozzle orifice 11 adjacent to the gas feed line 12. This leads to a corresponding decrease in the pressure exerted by the incoming gas on the liquid in the container 1 as the container passes by the nozzle 5*d* in the transport direction F2.

As a modification of the previously described and illustrated exemplary embodiments, the disclosure can also be used in conjunction with linear conveyors or combinations of circular and linear conveyors. The use of the inventive anti-slosh device also makes it possible to increase the startup speed or to reduce the braking time, since the inventive anti-slosh device prevents the liquid from the sloshing out at higher accelerations or faster braking. The nozzle which can be carried along with the container does not necessarily have to be carried along over the entire transport distance; it is sufficient for the nozzle to be carried along only as long as it is necessary to inject gas onto the surface of the liquid.

The invention claimed is:

1. System for conveying open containers filled with liquid, comprising a conveyor device for the containers and an anti-slosh device to prevent the liquid from sloshing out of the containers as they are being transported wherein the anti-slosh device has at least one nozzle for injecting a gas under pressure into the interior of the container, the at least one nozzle being directed at a point of most likely surge formation.

2. The system according to claim 1, wherein there is a first conveyor device and a second conveyor device, and the anti-slosh device is installed in a transition area between the first and second conveyor devices.

3. The system according to claim 1, wherein the anti-slosh device acts over a certain predetermined transport distance.

4. The system according to claim 1, wherein the at least one nozzle is directed at an inside surface of the container close to and below the container opening.

5. The system according to claim 1, wherein the injection pressure is decreased from a higher pressure at the beginning to a lower pressure at the end.

6. The system according to claim 1, wherein the nozzle is a slot nozzle with a predetermined length in the transport direction.

7. The system according to claim 1, wherein the nozzle is stationary.

8. The system according to claim 1, wherein the nozzle can be carried along over a certain predetermined transport distance.

9. The system according to claim 1, wherein the conveyor device has a first circular conveyor for transporting the containers in a first transport direction and a second circular conveyor driven around a rotational axis to transport the containers in a second transport direction, and in that a transfer device is provided to transfer the containers from the first circular conveyor to the second circular conveyor, where the anti-slosh device is assigned to the transfer point, acts over a certain predetermined transport distance in the second transport direction, and has a nozzle to inject a gas into the container, the nozzle being directed at the inside wall of the container facing away from the rotational axis of the second circular conveyor.

10. Method for transporting open containers filled with liquid, comprising injecting gas under pressure onto a point of most likely surge formation in the interior of the container to prevent the liquid from sloshing out as the container is being transported, and decreasing the injection velocity from a higher flow velocity at the beginning of the injection process to a lower flow velocity at the end of the injection process.

11. The system according to claim 1, wherein the open containers comprise wide-necked containers.

* * * * *